US005377644A

United States Patent [19]

Krohm

[11] Patent Number: 5,377,644

[45] Date of Patent: Jan. 3, 1995

[54] METERING VOLATILE FUEL COMPONENTS TO A COMBUSTION ENGINE

[75] Inventor: Harald Krohm, Bochum, Germany

[73] Assignee: AFT Atlas Fahrzeugtechnik GmbH, Werdohl, Germany

[21] Appl. No.: 65,472

[22] Filed: May 21, 1993

[30] Foreign Application Priority Data

May 23, 1992 [DE] Germany ..... 4217152
May 17, 1993 [DE] Germany ..... 4316392

[51] Int. Cl.[6] ..... F02M 25/08; F02M 19/08
[52] U.S. Cl. ..... 123/520; 123/544
[58] Field of Search ..... 123/516, 518, 519, 520, 123/521, 522, 698, 545, 547, 549, 557, 544

[56] References Cited

U.S. PATENT DOCUMENTS

| | | | |
|---|---|---|---|
| 3,763,839 | 10/1973 | Alquist | 123/519 |
| 3,926,168 | 1/1975 | Csicsery | 123/519 |
| 3,933,130 | 1/1976 | Csicsery | 123/519 |
| 4,070,828 | 1/1978 | Barres | 123/521 |
| 4,279,233 | 7/1981 | Tobita et al. | 123/519 |
| 4,524,746 | 6/1985 | Hansen | 123/545 |
| 4,598,686 | 7/1986 | Lupoli et al. | 123/519 |
| 4,846,135 | 7/1989 | Tiphaine | 123/520 |
| 4,862,856 | 9/1989 | Yokoe et al. | 123/520 |
| 5,048,501 | 9/1991 | Smith et al. | 123/545 |
| 5,054,453 | 10/1991 | Onufer | 123/522 |
| 5,054,454 | 10/1991 | Hamburg | 123/520 |
| 5,158,054 | 10/1992 | Otsuka | 123/520 |
| 5,170,765 | 12/1992 | Hoshino et al. | 123/520 |
| 5,173,095 | 12/1992 | Yasukawa et al. | 123/519 |
| 5,193,512 | 3/1993 | Steinbrenner et al. | 123/519 |
| 5,216,998 | 6/1993 | Hosoda et al. | 123/698 |
| 5,224,456 | 7/1993 | Hosoda | 123/520 |
| 5,231,969 | 8/1993 | Suga | 123/520 |

*Primary Examiner*—E. Rollins Cross
*Assistant Examiner*—Thomas N. Moulis
*Attorney, Agent, or Firm*—Darby & Darby

[57] ABSTRACT

Method and apparatus for the directed collecting and metering of volatile fuel components for an engine, including a container with a regenerable storage device for collecting volatile fuel components from the fuel store. The storage device is connected to the engine fuel inlet through a metering valve which is controlled to supply the previously collected components to optimize engine performance by a controlled feed of the volatile components into the fuel mixture according to the particular engine operating conditions. In accordance with the invention, the device controls the metering valve dependent upon the desired mixture of volatile fuel components for the particular running conditions.

16 Claims, 3 Drawing Sheets

METERING VOLATILE FUEL COMPONENTS TO A COMBUSTION ENGINE

FIELD OF THE INVENTION

The invention relates to a method and apparatus for collecting volatile fuel components (fractions) in a storage system and subsequently their use as part of the fuel fed to the cylinders of an engine.

BACKGROUND OF THE INVENTION

Fuels nowadays consist not of a single chemical compound, but of a plurality of so-called fractions of differing composition and concentration. Each of the fractions has differing chemical and physical properties axed accordingly provides different properties as a motor fuel component.

The strategy and tuning of current combustion engines are directed to achieving, from the overall mixture of properties present in the fuel, optimum motor operation and combustion, particularly with regard to a reduction in environmental damage.

The highly volatile components, particularly alcohols, in the fuel tank lead to evaporation emissions, which can be captured in a storage device on a filter used with the engine. Since, in particular, the highly volatile components evaporate, they have a composition which is different from the mixture contained in the fuel tank.

Storage devices are known for reducing evaporation emissions from vehicles with internal combustion engines. One component of such systems is a control device to empty the storage device by connecting it to the conbustion process.

Accordingly, an object of collecting the fuel components which can be denoted "evaporation emissions" is the prevention of their release into the atmosphere.

The object of the controlled feed of the initially collected together portions is to empty or regenerate what is collected in the storage device in order that the device is then available for a fresh filling process.

The construction and mode of operation of such systems is known to be matched to the intended purpose and, in particular, these are known to consist of:

A storage device, preferably an active charcoal device, is charged with fuel components essentially by the vapor pressure of the fuel. Regeneration takes place as a rule by means of the inlet suction of the engine, preferably under operating conditions. The admixture of the contents of the storage device to the remainder of the combustion mix (fuel) should cause as little disturbance as possible to the fuel and the operation of the engine.

OBJECTS OF THE INVENTION

It is an object of the present invention to provide a method and apparatus in which such volatile fuel components are collected and later used as part of the fuel mix, to improve the effectiveness of their use.

It is a particular object of the present invention to use such highly volatile components in the fuel mixture to be combusted by the engine by feeding them actively into the fuel mixture and by adjusting the feed to the particular engine operating conditions.

BRIEF DESCRIPTION OF THE INVENTION

Generally, in accordance with the invention, there is provided, in a method and system for collecting and metering volatile fuel components to an internal combustion engine a container have a regeneratable storage device for collecting the volatile fuel components, a conduit connecting the storage device with a fuel inlet (suction) of the engine and a metering valve in the connection path. The invention further includes a control device which is provided with information of the motor functioning and motor operational conditions. The control device controls the metering valve corresponding to the desired admixture of the volatile fuel components according to the particular operational condition of the engine.

Operating conditions in which an extra feeding of the collected volatile components takes place are, apart from steady running, in particular are the conditions in which the addition of easily vaporizable components is thought to be not damaging, but rather advantageous. Typical of such conditions are: cold smarting, hot running conditions and full load operation with danger of knocking. As one example of this, it is useful to consider the tendency of certain fuel components to cause engine knocking.

It is known that certain physical and chemical properties of the individual components are linked rather than being independent of each other. For example, there is a general correlation between component properties such as a tendency to cause knocking and the component's vaporizing temperature range. This enables the use of a selection process directed to the vaporizing temperature for collecting components which, in given operational conditions, in the case being considered, full load operation, are of advantage.

The invention differentiates itself accordingly, as far as the state of the art is concerned, in that the highly volatile components are additionally metered in to the combustion mixture in a fashion matched to the engine's particular operating conditions in order to promote optimum motor engine running. Accordingly, notice is taken of the fact that the volatile components collected together in the filter have specific physical and chemical properties.

The invention starts from the point that the individual components of the overall fuel mixture should be used purposely and should be allotted appropriately to the respective requirements of motor operating conditions. The invention has ever greater importance as a result of the face that to an increasing degree, further components are being added today to basic fuel mixtures, for example, variable addition of, e.g., alcohols in an additive amount of between 0 and 100% in order to match fuels to the requirements of "flexible fuel" vehicles and to make so-called "reformulated fuels".

It is advantageous, in connection with putting the invention into practice, that in recent times, albeit for a different purpose, viz. so-called tank venting systems, various practical engineering components are now commercially available or are under development.

Optimization of motor running thereby becomes possible in that additional metering takes place particularly during the operating conditions of cold start, warm running, acceleration and any operating conditions giving rise to a danger of engine knocking.

Additional metering independent of the inlet manifold suction is possible by providing, in the path connecting the storage device and the fuel inlet suction channel, or inlet manifold, a pump likewise controlled by the control device.

A large storage device capacity and simple regeneration can be affected by making the storage device with an active charcoal filter.

The control, both in terms of venting and also in terms of regeneration, is improved in this connection if the storage device is able to communicate via a channel of the metering valve to the atmosphere.

In order to make the desired amount of regeneration take place independently of the temperature of the storage device, the storage device can itself be fitted with a heating device.

It can be advantageous also if for collecting separate fractions, separate regions of the storage device are provided. An alternative which may also prove appropriate is to provide several different storage devices, each for a different fraction.

In such a case, it can be of particular advantage if the control device is adapted to effect the specific release of the individual fractions from the regions of the respective storage device region or storage device corresponding to the desired admixture of volatile fuel components, having regard to the particular operational condition of the engine.

Generally speaking, it can be useful if the storage regions or separate devices can have their temperatures controlled, preferably individually.

In order to put the invention into practice, it can be advantageous if, when appropriate, additional units or features are provided, such as for example:

matched storage device volume, number of storage devices and their composition;

heating of the storage device to render the light vaporizing components ready for use even with unfavorable operating conditions (e.g., low temperatures) or for an active solution to the process of selection of fuel components;

active additional measuring units (e.g., pumps and metering valves);

means to determine the quantity and concentration of the contents of the storage devices;

heating devices for the fuel container in order to provide support for carrying out an active thermal selection process to move volatile fractions from the fuel mix into one or more storage devices.

Furthermore, the invention relates also to a process for the differentiated collection and apportionment of individual volatile fuel components (fractions) for combustion engines, having at least one of the following features:

the selection of the individual components is made on a basis of the ability to differentiate their vaporization temperatures and vaporizing behavior.

the temperature for allocating the fraction is generated as a result of natural thermal processes (temperature reduction and rise from uncontrolled external influences such as tank filling, change in ambient temperature, etc.).

the temperature for allocating the fraction is generated by actively heating at least parts of the fuel.

the collection of the fractions takes place in a storage device.

the collection of the fractions takes place in several switchable storage devices, each storage device being selected corresponding to different vaporizing temperature ranges for the fuel components to be stored in the respective storage device.

the selection of the fractions takes place on the basis of the differing absorption behavior of parallel storage devices.

the storage device(s) is/are active charcoal containers.

The allotment of components from the one or more storage devices takes place depending upon the operating point corresponding to the combination of vaporizing behavior and behavior in the engine of the fractions.

DETAILED DESCRIPTION OF PREFERRED EMBODIMENT

Figure 1:
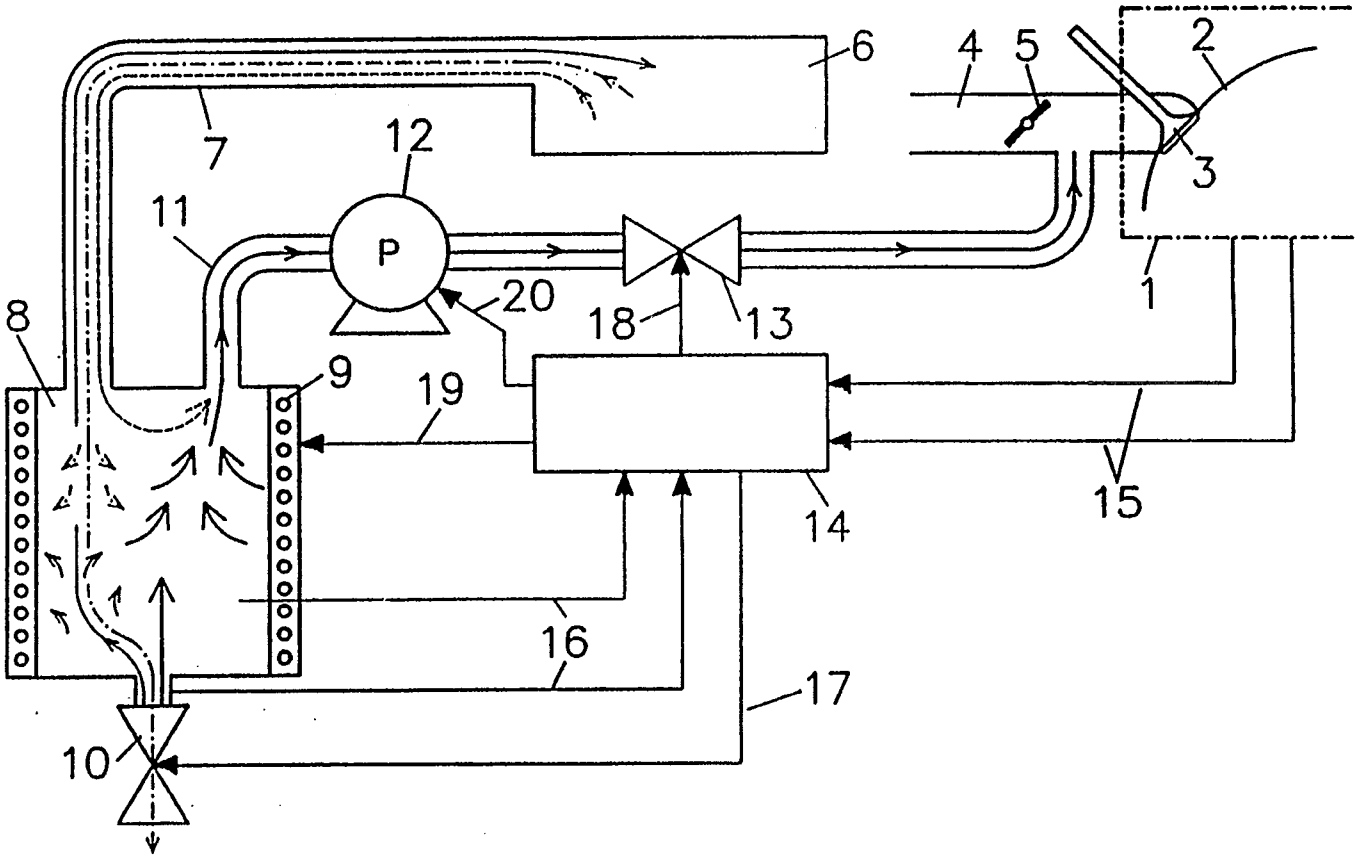
FIG. 1 is a schematic diagram of the invention.

A preferred embodiment of how to put the invention into practice is illustrated by way of example in the accompanying drawing and will now be specifically described.

Referring to the drawing, a combustion chamber of a schematically indicated engine 1 is illustrated as a cylinder 2 having a fuel inlet valve 3. An inlet channel 4 including a throttle flap 5 leads to the inlet valve 3. The engine 1 can be one operating with a carburetor or it can have fuel injection, i.e., it can be an onto engine.

A fuel tank 6 is connected via a conduit 7 to a storage unit 8 which is, for example, constructed as an active charcoal filter and which is provided with a heating unit 9. The storage unit 8 can, if desired, be a replaceable canister element. The storage device 8 is connected via a metering valve 10 to atmosphere. Additionally, a channel, or tubing, 11 connects the storage devices 8 via a pump 12 and a further metering valve 13 with the suction conduit 4.

A control device 14 receives, via leads 15, information concerning engine operating conditions. Control device 14 can be, for example, a microprocessor having inputs regarding engine conditions from sensors, e.g., engine temperature, engine speed, manifold pressure, etc. Such an arrangement is well known in the art.

The control device 14 via leads 16 also receives information about the load condition of the storage unit 8 as well as about the throughflow through metering valve 10.

The control device 14 also has a program which, on the basis of the information supplied to it, computes the quantity of the components to be metered to the engine fuel inlet in response to the measured conditions. This program can be stored with microprocessor RAM or ROM. The control device 14 controls engine functioning. In the present context, the control device 14 emits, via leads 17 and 18, control 1 signals for metering valve 10 and metering valve 13, respectively, via a lead 19 a control signal for the heating device 9, and via a lead 20 a control signal for pump 12. The control device 14 operates to meter the collected component in the storage device 8 to the engine inlets at a time and in an amount corresponding to the measured engine operating condition and the stored operation program.

Easily volatile components evaporating in the fuel tank 6 collect in the storage device 8 and are absorbed by the charcoal filter. The composition of these highly volatile evaporation components depends upon the composition of the fuel mixture. The metering valve 10 makes possible, particularly during shut-off periods of the engine, pressure equalization relative to atmosphere.

In operation of the engine, the control device 14 responds to those operating conditions of the engine in which an additional admixture of easily volatile fuel components would be desirable or at least which would not be damaging. This is the case particularly in a cold starting phase, a warm running phase, an accelerating phase or in any operating condition giving rise to danger of engine knocking. Then, corresponding to the operating condition, opening takes place of metering valves 13 and 10. Also, switching on of a pump 12 can take place so that air is sucked in through the storage unit 8. The filter of the storage device 8 is correspondingly unloaded and thereby regenerated, i.e., collected vapor fractions are removed. If necessary, for accelerating the vaporization of the fuel components from the filling of the storage unit, the heating device 9 is switched on.

Figure 2:
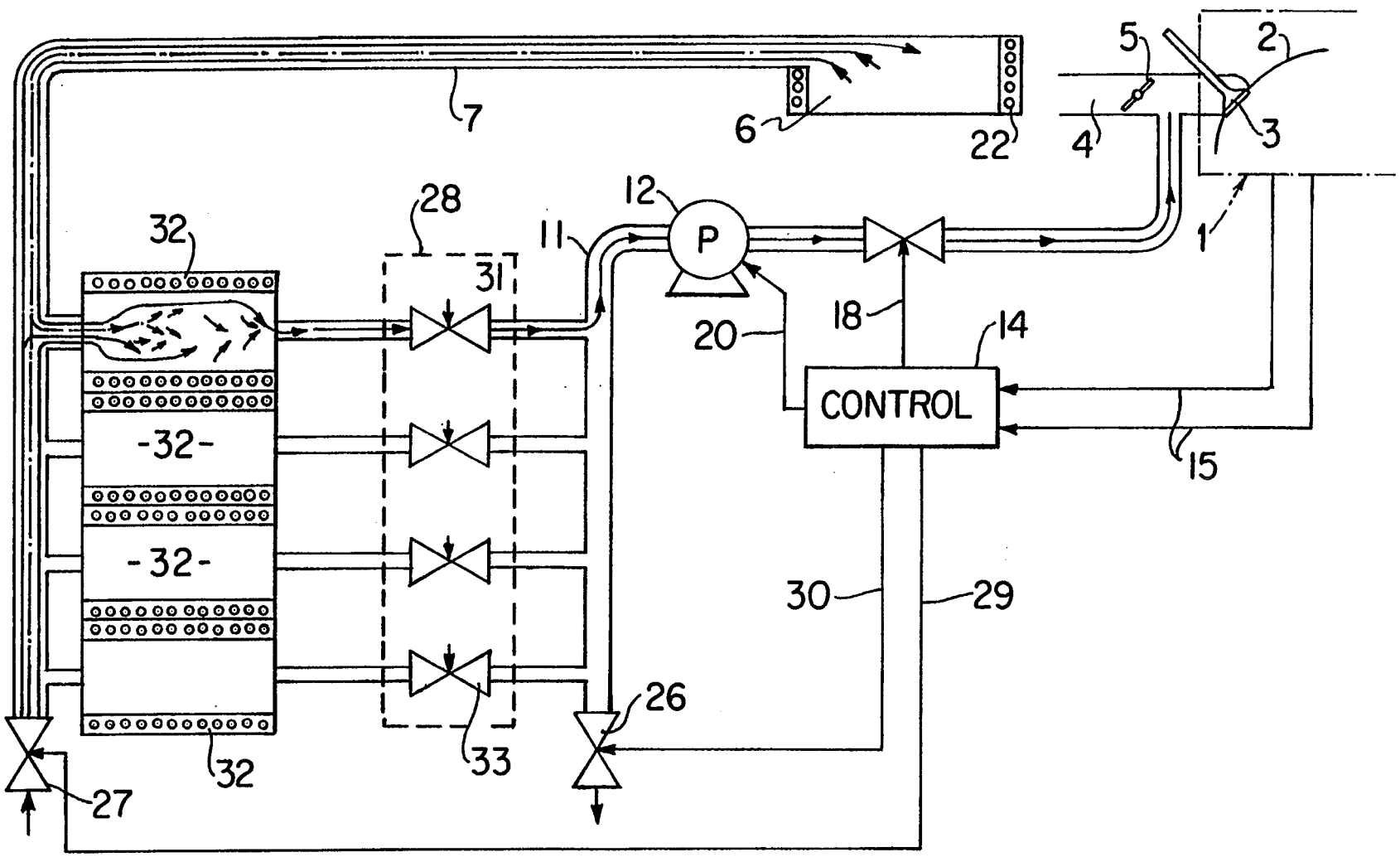
FIG. 2 is a schematic diagram of an alternative embodiment in accordance with the invention.

In another embodiment of the invention, the different type fractions are individually collected in separate regions of a single storage unit (FIG. 3) or in separate storage units (FIG. 2). This can be accomplished, for example, in accordance with the different vaporization temperatures or vaporizing temperature ranges of the individual components. Here, for example, each of the storage units opens under the control of a temperature sensitive arrangement, e.g., a temperature controlled valve or valve controlled by a temperature sensitive device, to collect the different components which are vaporized from the fuel mixture. This can be under the control of the control device 14 which in turn controls the openings of the different valves to the different storage units as the fuel in the tank 6 is cycled through a temperature range. The latter can be done naturally in response to the ambient temperature or by heating the fuel tank.

In FIG. 2, a path 11 is provided between each storage unit 8 and the fuel inlet, 4 with the output of each storage unit 8 being controlled by a valve 25 actuated by the control device 14. Here, depending upon the sensed operating conditions, the control device 14 operates to open individual outlet valves 23 and/or pumps from the respective storage units to selectively apply one or more of the individual collected components to the engine fuel inlet in the appropriate amount and at the appropriate time depending upon the sensed engine conditions and the program stored in the control device.

In greater detail, FIG. 2 shows an embodiment of the invention with several storage devices, 8, 21. As indicated in FIG. 2, the number of storage devices 8, 21 is not necessarily limited to two, but the quantity of devices 18, 21 can be adapted to the requirements. In the arrangement in FIG. 2, it is possible to supply the fractions selectively to the storage devices 8, 21, that is, to collect selectively, as well as to later supply the different fractions selectively to the internal combustion engine 1. This is made possible by control device 14, which can control valves 23 anti 24 by way of leads 20. Furthermore, (FIG. 2), it is possible, by means of the heater 22, to heat at least a portion of the fuel supply, which is in the fuel tank 6. Thus, volatile fuel fractions can be selectively driven from the fuel tank 6, by controlling the heating rate, and added to one of the storage devices 8, 21. This process can be effected by selectively triggering the associated valve 24 by means of the control device 14. Otherwise operational concepts are similar to the embodiment of FIG. 1.

Figure 3:
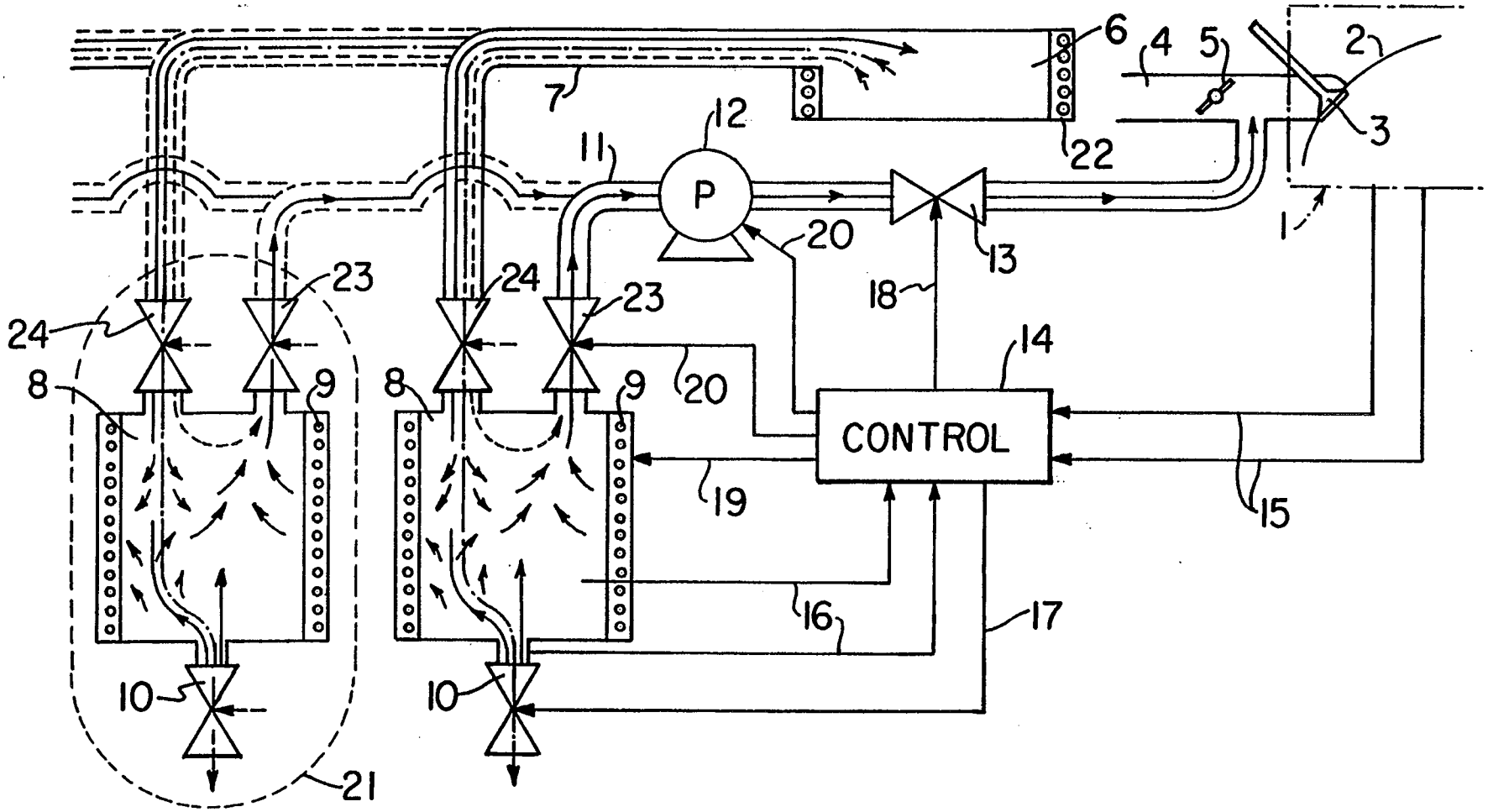
FIG. 3 is a schematic diagram of another alternative embodiment in accordance with the invention.

In FIG. 3, operation is comparable with that of title exemplified embodiment of FIG. 2. However, the storage areas are combined into a single storage unit 25, which is internally divided into separate regions. As a result, separate devices, similar to the storage devices 8, 21 of FIG. 2, do not have to be provided. This single unit 25 can be of advantage, for example, if the space for installing storage units is limited. The individual storage regions of the storage device 25 are individually provided with heaters 32, in order to heat the contents of the storage device, that is, the fuel fractions, selectively at suitable temperatures. Furthermore, a valve block 28 is utilized in the absorption as well as in the regeneration operation, to provide individual control over each region of storage. The valve block 28 is connected by a control lead 31 with the control device 14. A venting valve 26, which is connected by means of a control lead 30 with the control equipment 14, is open to the atmosphere during the absorption operation. On the other hand, the venting valve 27, which is connected by way of a control lead 29 with the control device 14, is open during the regeneration operation and thus can produce a connection between the atmosphere and the storage device 25 or the individual storage regions as determined by the valves in the block 28.

The separate storage units (FIG. 2) for the individual components or the separate regions of the single storage unit (FIG. 3) also can respond in other ways to the various vaporized fuel components. For example, this can be by the use of different types of filter media.

The patent claims submitted with the application are suggested formulations without prejudice to obtaining more broad patent protection.

I claim:

1. Apparatus for selectively collecting and separately metering individual different volatile fuel components and fractions to an internal combustion engine having a fuel supply, comprising:

regenerable storage means for selectively collecting different volatile fuel components from the fuel supply;

connecting means including a metering valve connecting said storage means with a fuel inlet of the engine, and control means for controlling said metering valve in response to respectively different predetermined engine operating conditions to selectively release at least a specific one of said volatile components from said storage means to said fuel inlet during one of said predetermined engine operating condition.

2. The apparatus of claim 1, wherein said control means operates to add said collected volatile fuel components into the fuel inlet during the different, predetermined engine operating conditions including cold starting, hot running, acceleration, and conditions giving rise to a danger of engine knocking.

3. The apparatus of claim 1 wherein said connecting means further comprises a pump connected to a conduit connecting said storage means with the engine fuel inlet and wherein the control means further controls the pump.

4. The apparatus of claim 1, wherein said storage means includes an active charcoal filter.

5. The apparatus according to claim 1, further comprising means including at least one valve controlled by said control means for connecting said storage means with the atmosphere.

6. The apparatus according to claim 1, further comprising means for heating at least a part of said storage means.

7. Apparatus for collecting and metering volatile fuel components and fractions to an internal combustion engine having a fuel supply, comprising:

at least one regenerable storage means for collecting volatile fuel components from the fuel supply which comprises at least one first storage unit including a plurality of separate storage areas for the separate collection of separated volatile components;

connecting means including a metering valve connecting said at least one storage means with a fuel inlet of the engine, control means for controlling said metering valve in response to engine operating conditions to selectively release said volatile components from said at least one storage means to said fuel inlet during such preselected engine operating conditions.

8. The apparatus of claim 7, wherein said control means operates for the specific release of individual volatile components from individual storage areas of said at least one first storage unit for desired mixing of volatile fuel components, said mixing being in response to a program controlling said control means, said program depending upon the respective selected engine operating condition.

9. The apparatus of claim 7, further comprising heating means for individually heating at least one of said separate storage means.

10. Apparatus for collecting and metering volatile fuel components and fractions to an internal combustion engine having a fuel supply, comprising:

at least one regenerable storage means for collecting volatile fuel components from the fuel supply comprising a plurality of second storage units, each of said second storage units separately collecting a specified component, connecting means including a metering valve connecting said at least one storage means with a fuel inlet of the engine, and control means for controlling said metering valve in response to engine operating conditions to selectively release said components from said at least one storage means to said fuel inlet during such preselected engine operating conditions.

11. The apparatus of claim 10, wherein said control means operates for the specific release of individual volatile components from said plurality of second storage units of said storage means for desired mixing of volatile fuel components, said mixing being in response to a program controlling said control means, said program depending upon the respective selected engine operating condition.

12. The apparatus of claim 10 further comprising heating means for individually heating at least one of said separate storage units.

13. Process for the differentiated collection and allotment of individual volatile fuel components separated from a fuel supply for use in combustion engines, comprising the steps of:

selecting individual fuel components from said fuel supply as fractions on the basis of differentiation of their vaporization temperatures;

collecting the fractions in individual storage units corresponding to the vaporization temperature ranges of the respective fractions; and supplying selected fractions to the engine fuel inlet to enhance engine performance in response to selected engine behavior, said supplying on the basis of the boiling properties of the selected fractions and the effect on engine behavior of the supplied fractions.

14. The method according to claim 13 wherein the fractions are supplied by vaporization of said fuel supply and vaporization of the fuel supply occurs naturally.

15. The method according to claim 13, further comprising the step of heating the fuel supply to vaporize the fuel components.

16. The apparatus of claim 1, wherein said control means is responsive to a computer program.

* * * * *